United States Patent [19]

Manservisi

[11] Patent Number: 4,574,958

[45] Date of Patent: Mar. 11, 1986

[54] CIGARETTE QUALITY CONTROL DEVICE

[75] Inventor: Renato Manservisi, Bologna, Italy

[73] Assignee: Sasib S.p.A., Bologna, Italy

[21] Appl. No.: 519,593

[22] Filed: Aug. 2, 1983

[30] Foreign Application Priority Data

Aug. 4, 1982 [IT] Italy ..... 12606 A/82

[51] Int. Cl.[4] ..... B07C 5/00

[52] U.S. Cl. ..... 209/535; 53/151

[58] Field of Search ..... 209/535–537, 209/644; 53/54, 57, 148–151, 498–500; 131/292, 283, 904–908; 221/176, 233

[56] References Cited

U.S. PATENT DOCUMENTS

| | | | |
|---|---|---|---|
| 3,189,178 | 6/1965 | Calleson et al. | 131/282 X |
| 3,207,308 | 9/1965 | Kemp | 209/535 |
| 3,435,940 | 4/1969 | Seragnoli | 53/151 X |
| 3,485,357 | 12/1969 | Payne | 209/537 |
| 3,720,311 | 3/1973 | Harrison, Jr. | 209/537 |
| 4,093,075 | 6/1978 | Molins | 209/535 |
| 4,174,780 | 11/1979 | Farrar et al. | 209/536 |
| 4,196,810 | 4/1980 | Gurioli | 209/535 |
| 4,376,484 | 3/1983 | Seragnoli | 209/535 |
| 4,445,520 | 5/1984 | Knight et al. | 131/282 |

FOREIGN PATENT DOCUMENTS

| | | | |
|---|---|---|---|
| 0313591 | 12/1929 | United Kingdom | 53/151 |
| 2061527 | 5/1981 | United Kingdom | 131/908 |

*Primary Examiner*—Robert B. Reeves

*Assistant Examiner*—Edward M. Wacyra

*Attorney, Agent, or Firm*—Spencer & Frank

[57] ABSTRACT

A quality control device for cigarettes moving through a hopper (1) to a cigarette-packing machine. The hopper has a lower section with a plurality of cigarette-guiding down channels (2) set side by side, with each channel guiding an individual pile of cigarettes (S) downward toward an underlying chamber where a cigarette batch consisting of at least one layer of cigarettes set side by side will be formed and then transferred to the cigarette-packing machine. Near each of the cigarette-guiding channels (2), a cigarette-inspection sensor is provided at one or both ends of the cigarettes to control a cigarette ejection mechanism for discarding any defective cigarette found. In each one of the cigarette-guiding channels (2) there is provided a rotary cigarette-transfer device (3) that separates the respective cigarette-guiding channel (2) into an upper section (12) and a lower section (22). The cigarette-inspection sensors are associated with at least one cigarette position in the upper sections (12) of the channels. Every rotary cigarette-transfer device is so constructed, and so operated by the respective cigarette inspection sensor or sensors, that it transfers every regular cigarette (S) from the upper section (12) to the lower section (22) of a cigarette-guiding channel (2), whereas it moves any defective cigarette (S1) into an intermediate position where the cigarette-ejection mechanism is provided.

10 Claims, 6 Drawing Figures

CIGARETTE QUALITY CONTROL DEVICE

BACKGROUND OF THE INVENTION

The invention relates to the devices for any cigarette quality control to be effected at the hopper for the cigarette feeding to a cigarette-packing machine, the said hopper comprising in its lower section a set of cigarette-guiding down channels set side by side, which are adapted for containing each only one individual pile of cigarettes, so as to allow them to slide downward, and which are directed toward an underlying chamber within which there is formed a cigarette batch consisting of at least one layer of cigarettes set side by side, and being ejected therefrom by a pusher member at time intervals, to be transferred to the cigarette-packing machine. In correspondence of each one of the said cigarette-guiding channels, cigarette inspection sensor means are provided either on one or on both of the cigarette end sides, the said sensors being responsive to the cigarette property to be checked, and controlling cigarette ejection means that are adapted for ejecting and discarding any cigarette found out as defective through the quality control operation.

Any desired cigarette quality control may be effected, and it may, for example, concern the degree of filling of one or both of the cigarette ends, and/or the presence of the filter tip, and/or the air-retaining quality of the cigarettes, and/or the density of their tobacco filler, and/or the soundness of their wrapper, and/or the degree of ventilation or any other quality of the cigarettes.

A cigarette quality control device of the above type is known from the U.K. patent application No. 2.073.576. In this device, the cigarette quality control by the respective sensor means is effected during the dwell interval between two successive downward steps of the cigarette piles through the cigarette-guiding channels in the hopper, everytime during the ejection of a cigarette batch from the chamber at the bottom of said cigarette-guiding channels. For each cigarette-guiding channel two superposed parallel feeler pins are provided on at least one, but preferably on either one of the cigarette end sides, the said feeler pins being movable transversely to the respective cigarette-guiding channel in the longitudinal direction of the cigarettes, in such a manner that they will each time get co-axially close to the ends of two consecutive cigarettes in the cigarette pile within the respective cigarette-guiding channel, and will thus effect the inspection of both cigarettes. For the rejection of the defective cigarettes a pneumatic ejector nozzle (blower) is employed, arranged in correspondence of each cigarette-guiding channel in the hopper, downstream of the respective feeler pins and co-axially to the position taken by the cigarettes after every downward step of the cigarette pile.

In the known device of the above-disclosed type, the cigarette quality control is effected at each cigarette-guiding channel in the hopper on two successive cigarettes in the cigarette pile, whereby it is prevented that a cigarette might come down by a step before being checked, and might thus elude its quality control in the case of ejection of one underlying cigarette having been found out as defective through a preceding quality control operation, which would otherwise occur, should the quality control be effected at one single location, that is in correspondence of the position of only one cigarette in the pile. Accordingly, by adopting a quality control through two superposed feeler pins spaced apart by a distance corresponding to one downward step of the cigarettes, a cigarette having eluded the inspection by the upper feeler pin during one operative cycle in which a defective cigarette is being expelled downstream of the feeler pins, and the whole cigarette pile is being lowered by one step, will be inspected by the lower feeler pin during the subsequent operative cycle.

The above-disclosed known device however has the drawback of failing to check one cigarette whenever two consecutive defective cigarettes in the pile will be ejected. In this case, in order to prevent any failure in the quality control, inspection means should be provided in correspondence on three successive positions of the cigarettes, beside each one of the cigarette-guiding channels in the hopper. However, also in this case the quality control of one cigarette would fail to be effected, should three consecutive defective cigarettes be cast away from the cigarette pile. This is a serious disadvantage when considering that especially at the high output rates of the present cigarette-packing machines, a slight defect in the cigarettes, due to any transient cause, might occur in a relatively great number of cigarettes.

SUMMARY OF THE INVENTION

The object of the invention is to eliminate the above-described drawback of the heretofore known devices of the type as disclosed in the preamble, and the invention aims to guarantee the quality control of every successive cigarette in each one of the cigarette-guiding channels of the cigarette-feeding hopper, in a manner quite independent from the number of any defective consecutive cigarettes being expelled from a cigarette-guiding channel.

This problem is solved by the invention through the provision in every cigarette-guiding channel of a rotary cigarette-transfer device separating the respective cigarette-guiding channel into an upper and a lower section, the cigarette-inspection sensor means being here arranged in correspondence of the upper section of every cigarette-guiding channel and being associated with at least one cigarette position in this upper channel section, and the rotary cigarette-transfer device being so constructed, and so operated by the said cigarette-inspection sensor means that any regular cigarette will be transferred thereby from the upper to the lower section of every cigarette-guiding channel, while any defective cigarette will be moved by the same into an intermediate discard position, beside which the cigarette ejection means are provided.

In one preferred embodiment of the invention, the frequency at which the cigarettes are being transferred by each rotary cigarette-transfer device provided in each cigarette-guiding channel of the cigarette-feeding hopper, is so selected that in a unit of time a cigarette number greater than that taken in by the cigarette-packing machine will be transferred to the lower section of the cigarette-guiding channels, and the lower section of the cigarette-guiding channels is of a length (height) enabling to store therewithin a certain supply of cigarettes, of which both the minimum and the maximum levels are controlled—respectively by means of a lower sensor stopping the cigarette-packing machine as long as the level of the said cigarette supply is below the minimum level, and of an upper sensor stopping the respective rotary transfer device as long as the level of the said cigarette supply is above the maximum level. In this embodiment of the invention, the maximum number of defective cigarettes that can be discarded the one after the other from each cigarette-guiding channel in the hopper for the cigarette feeding to the cigarette-packing machine depends on the frequency at which the cigarettes are transferred by the rotary cigarette-transfer device provided in every cigarette-guiding channel, and on the minimum permissible level of the cigarette supply within the lower section of every cigarette-guiding channel.

BRIEF DESCRIPTION OF THE DRAWINGS

These and other characteristic features of the invention and the advantages arising therefrom will spring out in greater detail from the following specification of one preferred embodiment thereof, shown in a very schematic manner and by way of a non-limiting example in the accompanying drawings, in which.

DESCRIPTION OF THE PREFERRED EMBODIMENT

Referring to the figures, 1 denotes the hopper for the cigarette feeding to a cigarette-packing machine. In its lower portion, this hopper 1 comprises at least one set of cigarette-guiding down channels 2, which are adapted for containing each one unitary pile of cigarettes, that is a pile formed by only one column of superposed parallel cigarettes S.

Figure 2:
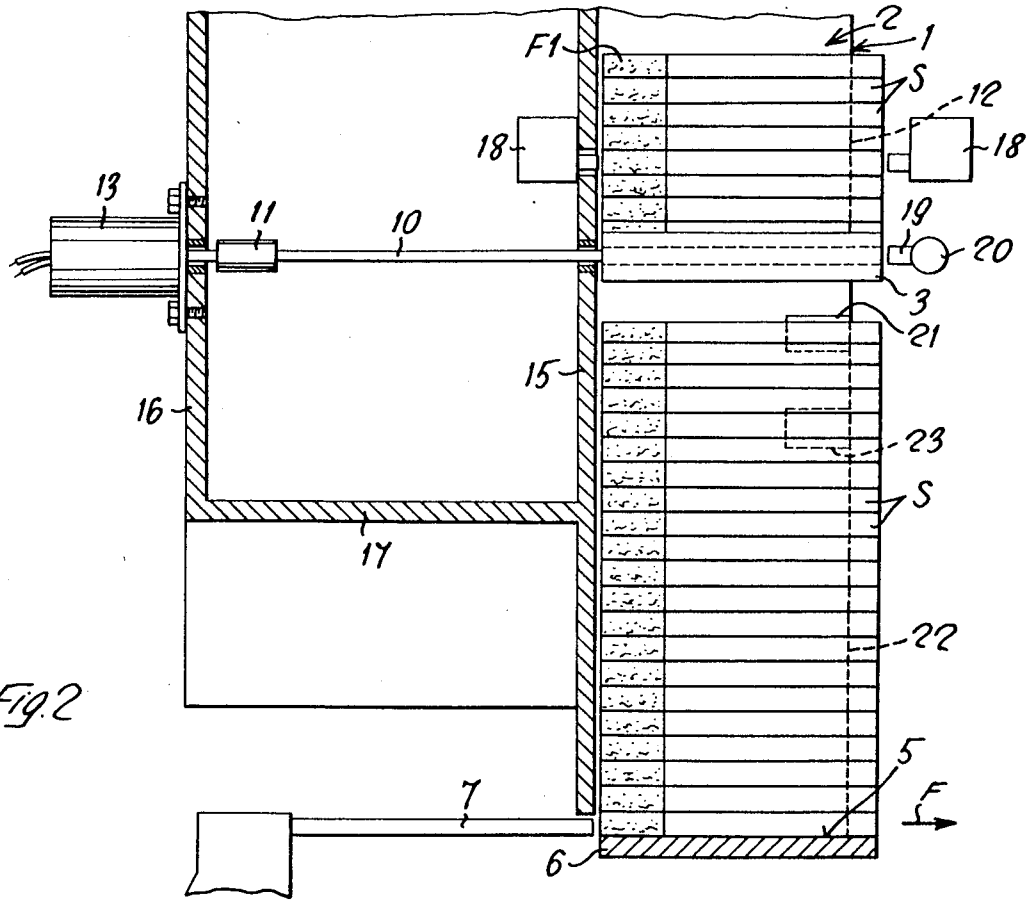
FIG. 2 is a vertical section through the said cigarette-guiding channels, taken on line II—II of FIG. 1.

By a rotary cigarette-transfer device 3 to be described in detail hereinafter, each cigarette-guiding channel is separated into an upper section 12 and a lower section 22. The upper sections 12 of the cigarette-guiding channels 2 are vertical and parallel to each other, and are delimited by partition walls or baffles 14 of a same thickness. Whereas the lower sections 22 of the cigarette-guiding channels 2 converge in the manner of a fan toward a lower chamber 5, into which they open by their bottom ends. Owing to their convergent arrangement, the lower sections 22 of the cigarette-guiding channels 2 are delimited by partition walls or baffles 24 tapering downward in a wedge-like manner. The lowermost cigarettes in the piles of cigarettes S contained in the lower sections 22 of the cigarette-guiding channels 2, bear on the bottom plate 6 of the lower chamber 5 so as to form a row of contiguous cigarettes S. This cigarette row is expelled in the direction of arrow F in FIG. 2 by a suitable pusher member 7 and is transferred into a collection container provided in the cigarette-packing machine, within which an orderly batch of cigarettes to be packed will be formed layer by layer through successive like operations.

The lower ends of the upper baffles 14 and the upper ends of the lower baffles 24 are so profiled and jointed together as to form—in combination with a suitable construction of the sidewalls 8 of hopper 1, cylindrical housings 9 between the respective upper sections 12 and the corresponding lower sections 22 of the cigarette-guiding channels 2. In each housing 9 there is rotatably mounted one rotary cigarette-transfer device 3 consisting of a cylindrical roller of a same length as the cigarettes S, and being peripherally provided with two longitudinally extending, diametrically opposite flutes 103, which are adapted for containing each one cigarette S. Each rotary cigarette-transfer roller 3 also has two diametrically opposite, longitudinal through ducts 203, the position of which is angularly offset by 90° with respect to the peripheral flutes 103. Both the flutes 103 and the ducts 203 in each cigarette transfer roller 3 are open at the said roller head ends.

Every cigarette transfer roller 3 which is rotatably mounted in its own housing 9 between the upper section 12 and the lower section 22 of the respective cigarette-guiding channel 2, has its rear end secured to a co-axial spindle 10 which by means of a coupling 11 is connected to an electric, preferably stepwise-operated, motor 13. The spindle 10 is supported in the wall 15 defining the back of the cigarette-guiding channels 2, and is also supported in another fixed wall 16 which is parallel to wall 15 and is spaced apart therefrom by a distance being greater than the length of one cigarette S. Thus, between the two walls 15 and 16 a waste cigarette chamber is formed, which might be provided with a sloping bottom wall 17, and into which there will be cast the defective cigarettes, as fully disclosed later.

Figure 1:
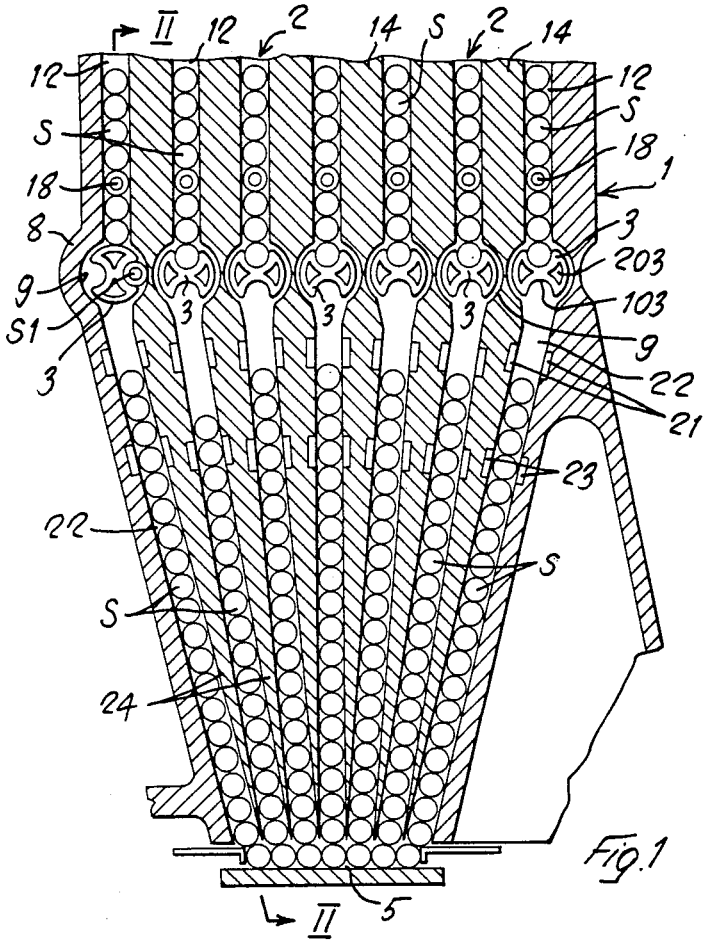
FIG. 1 is a vertical section cut transversely to the cigarettes through a set of cigarette-guiding channels provided in the hopper for the cigarette feeding to the cigarette-packing machine, and with a cigarette quality control device according to the invention being associated with each one of said channels.

Beside the upper section 12 of each cigarette-guiding channel 2, and at a level above its rotary cigarette-transfer roller 3, a cigarette-inspection sensor means 18 shown by a circlet in FIG. 1 and being responsive to the property to be checked in the cigarettes, is provided in correspondence of least one or both of the end sides of a cigarette S. This cigarette inspection sensor 18 may be of any desired type and it may, for example, be of the optical, particularly the optical fibre type, or of a mechanical, particularly the feeler pin type, and may respond, for example, to the presence of the filter tip F1 in the cigarettes S, and/or to the degree of filling of the respective cigarette end. However, also any kind of quality control, such as the control of the air-retaining quality of the cigarettes, may be effected by means of pneumatic and electric sensors, or the like.

At the front end of every housing 9 for the rotary cigarette-transfer device in each cigarette-guiding channel 2, there is provided a blowing ejector nozzle 19 extending parallel to the direction of the axis of the transfer roller 3 as far as against the fore head end thereof, and being situated at the same level as, but sideward of the central line drawn through the transfer roller 3, so as to be located in correspondence of the flutes 103 and the through ducts 203. The blowing ejector nozzles 19 for the cigarette-guiding channels 2 are all connected to a common, compressed air-feeding duct 20.

The lower section 22 of each cigarette-guiding channel 2 is of such a length that this section can contain a certain supply of cigarettes. In correspondence of the higher zone of said lower section 22, a maximum level upper sensor 21 and a minimum level lower sensor 23 are provided. Also these level sensors 21, 23 may be constructed in any desired manner, which should be however adapted for establishing the presence or the absence of a cigarette S at the respective sensor 21, 23, and may, for example, be of the capacitive type or of the photoelectric cell type.

Figure 3:
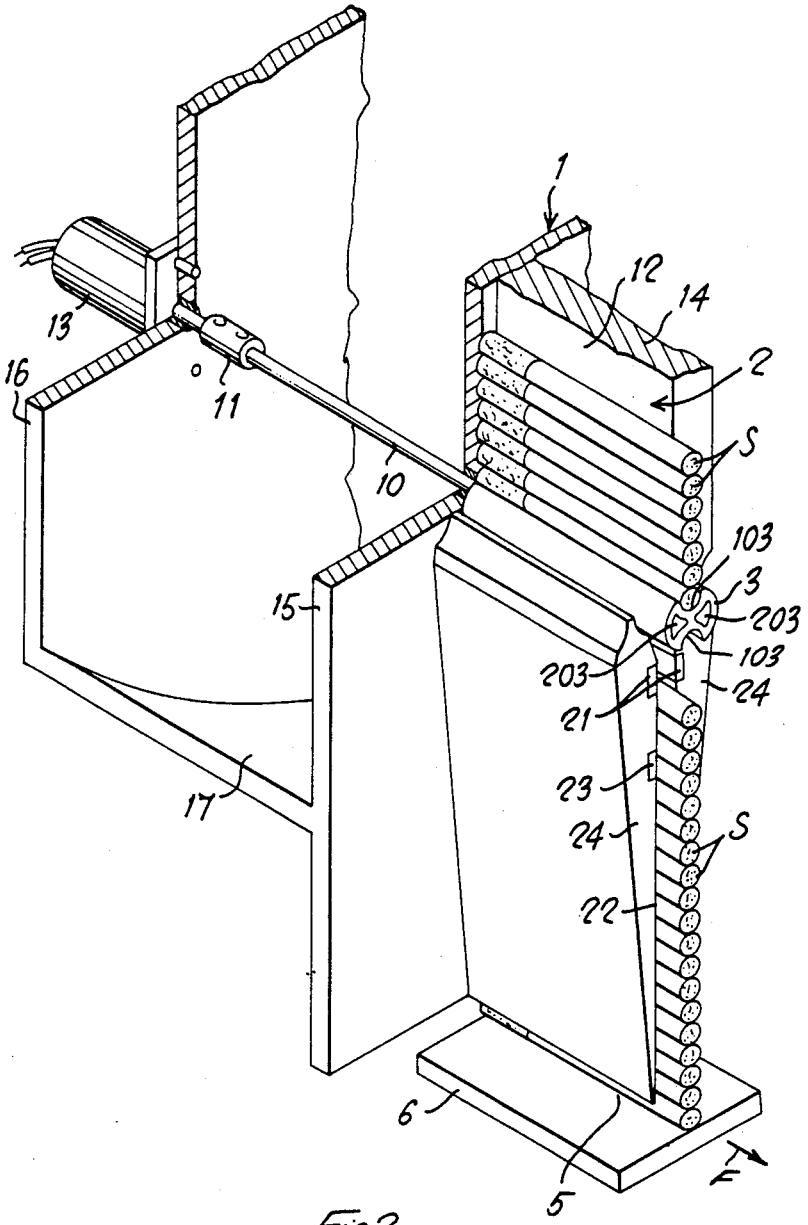
FIG. 3 is a perspective view with parts in section and parts broken away, showing one of the cigarette-guiding channel of the hopper according to FIGS. 1 and 2.
Figure 4:
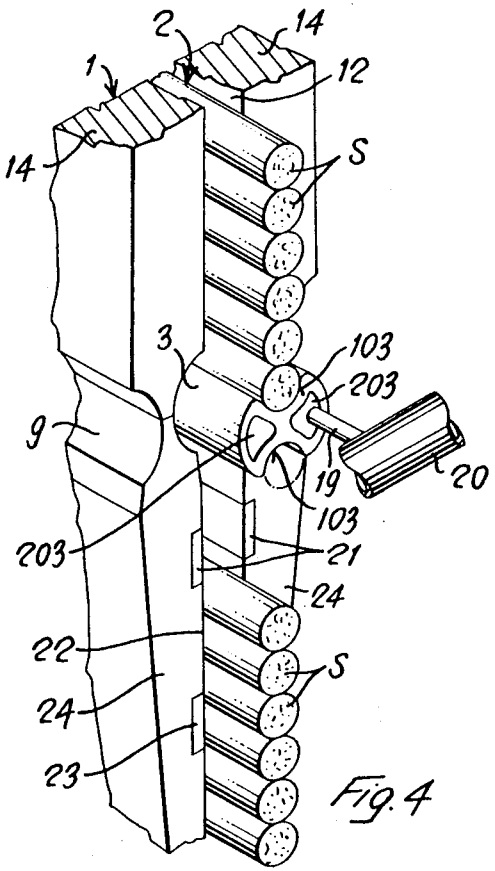

In the normal halt position of the cigarette-transfer rollers, as shown in FIGS. 3 and 4 for one transfer roller, and in FIG. 1 for all the transfer rollers in the cigarette-guiding channels 2 but the first one on the left-hand side, the two diametrically opposite flutes 103 in each cigarette transfer roller 3 are disposed vertically, that is to say, one of these peripheral flutes 103 is turned upwards and there is received the lowermost cigarette in the cigarette pile contained in the upper section 12 of the respective cigarette-guiding channel 2, while the other peripheral flute 103 is turned downward and opens to the underlying lower section 22 of the same cigarette-guiding channel 2. In the normal operation, that is when all the cigarettes S contained in the upward flutes 103 of the cigarette transfer rollers 3 are regular and flawless, all the transfer rollers 3 are simultaneously rotated through 180°, whereby the angular position of their diametrically opposite peripheral flutes 103 is reversed, and one regular cigarette is transferred by each one of them from the upper section 12 to the lower section 22 of the respective cigarette-guiding channel 2.

Figure 5:
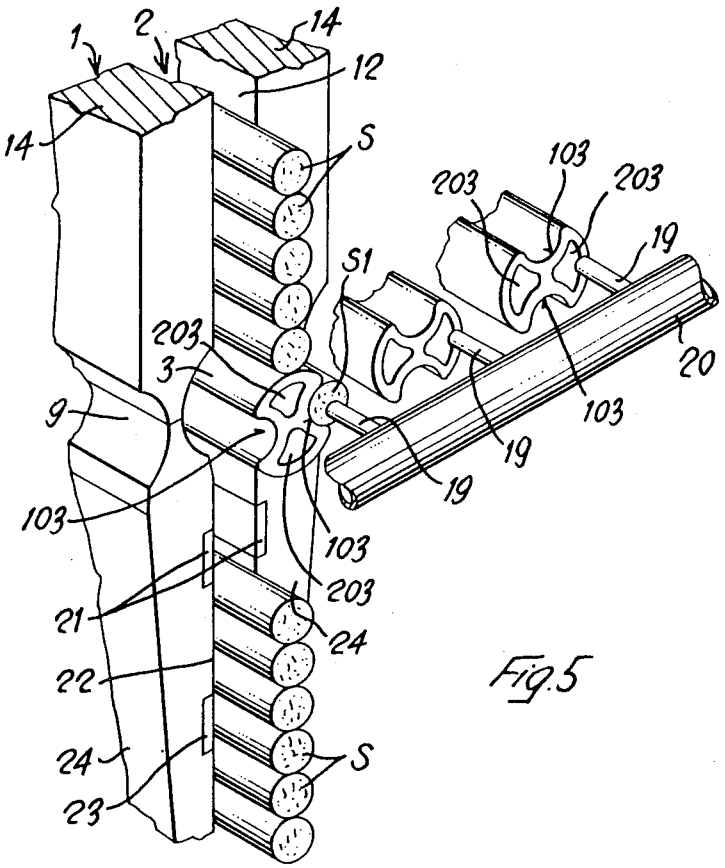
FIGS. 4 and 5 are perspective views showing in an enlarged scale a portion of one cigarette-guiding channel of the hopper according to FIGS. 1 to 3, with its respective rotary cigarette-transfer device in two different operative positions.

Whereas, when the cigarette S1 contained in the upward flute of one cigarette-transfer roller 3 has been found out as defective by one of the cigarette inspection sensors 18 provided upstream of the transfer rollers 3 in correspondence of each one of the upper sections 12 of the cigarette-guiding channels 2, the said one transfer roller will be rotated only through 90°, whereby its upward flute and thus the defective cigarette to be discarded, contained therewithin, will be moved into alignment with its associated blowing nozzle 19, as shown in FIG. 5, and also in FIG. 1 for the transfer roller 3 in the first cigarette-guiding channel 2 on the left-hand side. On completion of the 180° rotation of the other transfer roller 3 whereby the regular cigarettes which were contained in the upward flutes thereof are dropped each into the lower section 22 of the respective cigarette-guiding channel 2, compressed air is supplied into duct 20 and jets out from every one of the blowing nozzles 19. The airjet from that nozzle 19 which is associated with the defective cigarette-transferring roller 3 having been rotated only through 90°, ejects the defective cigarette S1 from the said transfer roller flute 103. The thus rejected cigarette passes through an opening provided in wall 15 co-axially to the blowing nozzle 19, and falls down into the waste cigarette chamber between the walls 15 and 16. Whereas the airjets from those blowing nozzles 19 which are associated with the regular cigarettes-transferring rollers 3 having been rotated through 180°, will flow through one of the longitudinal ducts 203 in the respective cigarette-transfer roller 3, whereby any prejudicial turbulence is avoided.

From the foregoing, it is apparent that the cigarettes contained in the upper section 12 of every cigarette-guiding channel 2 are caused to come down by steps at a rate which is determined by the rhythm according to which the cigarette transfer rollers 3 are rotated, so that every one of these cigarettes will dwell for a short time in front of the respective sensor or sensors 18, where their quality control is effected. The rhythm according to which the cigarette transfer rollers 3 are rotated, and therefore the rate at which the cigarettes S are fed to the lower sections 22 of the cigarette-guiding channels 2, is greater than the rate at which the cigarettes are delivered from the bottom end of the cigarette-guiding channels by the pusher 7. Consequently, when in the cigarette-guiding channels there are no defective cigarettes to be rejected in the above-disclosed manner, the level of the cigarettes S contained in the lower sections 22 of the cigarette-guiding channels 2, might increase up to stuff up the said channels. This however does not occur, since the rotation of each cigarette transfer roller 3 will be inhibited any time the level of the cigarettes in the lower section 22 of the respective cigarette-guiding channel 2 has reached the corresponding maximum level upper sensor 21. Whereas, when the level of the cigarettes S in the lower section 22 of a cigarette-guiding channel 2 has decreased below the respective minimum level lower sensor 23, for example owing to repeated rejections of defective cigarettes or to an upstream block resulting in the interruption of the cigarette feeding to the respective upper section 12, it is the cigarette-packing machine that will be stopped.

Figure 6:
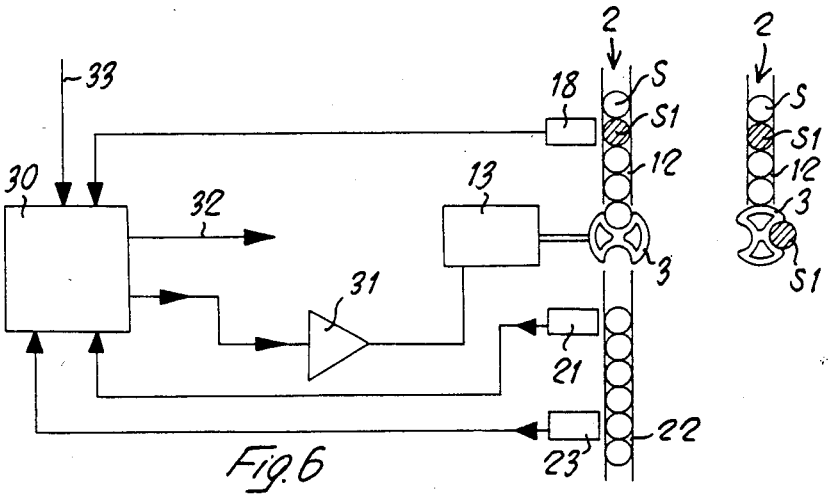
FIG. 6 shows the wiring for the cigarette quality control device according to FIGS. 1 to 5.

In FIG. 6 there is illustrated the block diagram of the electronic circuitry determining the above-disclosed operation. By 30 there is designated a microprocessor, or the like, which performs the following functions:

(a) it receives and stores the error signal (defective cigarette S1) from the cigarette inspection sensor or sensors 18 provided at the upper section 12 of every one of the cigarette-guiding channels 2, and accordingly it sends out a discard signal through output 32, whereby it promotes the delivery of compressed air to duct 20 by the time the cigarette S1 which was found out as defective by the respective sensor or sensors 18, has been received in the upward flute 103 of the corresponding cigarette transfer roller 3, so that the defective cigarette will be discarded by the ejector nozzle 19 arranged in front of the said transfer roller.

(b) Through an amplifier 31 it controls the rotation of the motor 23 driving each one of the transfer rollers 3 either continuously through 180° when the cigarette contained in the upward flute 103 of a transfer roller 3 is a regular cigarette, or through two steps of 90° each with a short halt after the first step, when the said cigarette is a defective cigarette to be discarded by the respective ejector nozzle 19.

(c) It receives the signal from the maximum level sensor 21 arranged in the lower section 22 of each one of the cigarette-guiding channels 2 and depending upon the said signal, it either enables or latches the rotation of the motors 13 actuating every one of the cigarette transfer rollers 3. More particularly, the rotation of a motor 13 will be latched any time the maximum level sensor 21 has detected the presence of a cigarette, while it will be enabled when the said sensor 21 has not detected the presence of any cigarette.

(d) It receives the signal from the minimum level sensor 23 arranged in the lower section 22 of each one of the cigarette-guiding channels 2 and depending upon the said signal, it either enables or latches the operation of the cigarette-packing machine. More particularly, the minimum level sensor 23 enables the operation of the cigarette-packing machine when it detects the presence of a cigarette, whereas, when it doesn't, it stops the operation of the said machine.

The cigarette transfer rollers 3 are driven in rotation at a fixed rhythm which is determined by a rate signal applied to the input 33 of the microprocessor 30. This rate signal promotes the synchronous starting of the rotation of the motors 13 actuating all the transfer rollers 3, and the rate corresponds substantially to the largest cigarette intake by the cigarette-packing machine, however increased by a certain percentage such as, for example, 20%. Consequently, from the average cigarette flow through every one of the cigarette-guiding channels 2 it is possible to cast away at the most a number of defective cigarettes S1 which corresponds to the said percentage. From each cigarette-guiding channel it is however possible to discard the one after the other and with no problem, a number of defective cigarettes S1 which corresponds to the number of cigarettes being present in the respective lower section 22 of every cigarette-guiding channel 2. In fact, since the cigarette transfer rollers 3 are all simultaneously driven in rotation, one cigarette less will be every time fed to the lower section 22 of the cigarette-guiding channel 2 from which a defective cigarette S1 has been discarded.

Of course the invention is not limited to the just described and shown embodiment, but it can be widely changed and modified, the more so in construction and in connection with any technical equivalent. More particularly, the rotary cigarette-transfer devices 3 may be constructed in several different manners, and these devices might have, for example, only one peripheral flute 103, or more than two peripheral flutes 103, wherefore they will be caused to rotate in the suitable manner for obtaining an operation which is similar to the described one. Moreover, each rotary cigarette-transfer device provided, for example, with four or six peripheral flutes 103, might be rotated by steps of, for example, 90° or 60°, so as to have one cigarette, even a regular cigarette, moved at every step to an intermediate sideward position into alignment with a blowing ejector nozzle 19, which will be however actuated only when a cigarette having been previously found out as defective by the appertaining cigarette-inspection sensor means, comes to be in correspondence of said nozzle. When the rotary cigarette-transfer device 3 has only one peripheral flute 103, this device may be driven at every operative cycle into a stepwise rotation consisting of one first step through 180° and of a second step through 180°, whereby to transfer a regular cigarette, or into a stepwise rotation consisting of one first step through 90° and of a second step through 270°, when a defective cigarette is to be discarded. In place of the blowing ejector nozzles 19, any other ejector means of the pusher type, such as mechanical ejector means, may be provided. The cigarette-inspection sensors 18 which as specified in this disclosure, may be of many different types and may perform different functions, might be also provided at more stations for the cigarettes coming down by steps through the upper sections 12 of the cigarette-guiding channels 2, especially when more subsequent inspections of the cigarettes need to be effected. Of course, the invention is not limited to the embodiment here shown and described, but broad changes and modifications may be made thereto without departing from the leading principle as set forth hereinabove and as claimed hereinafter.

What I claim is:

1. A device for controlling the quality of at least one cigarette property as cigarettes move through a hopper to a cigarette-packing machine, the hopper having a plurality of downwardly extending cigarette-guiding channels that are set side by side, with each channel accommodating a single pile of cigarettes so as to allow them to slide downward toward an underlying chamber where cigarette batches consisting of at least one layer of cigarettes set side by side are formed for subsequent removal to the cigarette-packing machine, comprising:

a plurality of cigarette-inspection sensor means for checking said at least one cigarette property, each sensor means being disposed along a respective channel and being exposed, at at least one cigarette position in the respective channel, to at least one end of cigarettes moving through the respective channel;

a plurality of cigarette ejector means for discarding defective cigarettes, each ejector means corresponding to a respective channel; and a plurality of rotary cigarette-transfer device means, each disposed in a respective channel and separating the respective channel into upper and lower sections, with the respective sensor means being located at the upper section, for transferring a cigarette from the upper section of a respective channel to the lower section thereof if the respective sensor means does not detect a defect in the cigarette and for transferring the cigarette to a respective intermediate position for removal by the respective ejector means if a defect is detected, wherein each cigarette-transfer device means includes a roller having at least one peripheral flute, each at least one peripheral flute being configured to accommodate one cigarette and being rotatable from a cigarette-receiving position in communication with the upper section of the respective channel, through the respective intermediate position in alignment with the respective ejector means, to a cigarette-delivery position in communication with the lower section of the respective channel, and means for rotating the roller simultaneously with the rollers of all other cigarette-transfer device means and at a predetermined rhythm, with a roller which receives a non-defective cigarette being rotated from the cigarette-receiving position to the cigarette-delivery position and with a roller which receives a defective cigarette being rotated from the cigarette-receiving position and halting at the respective intermediate position before preceding to the cigarette-delivery position.

2. The device according to claim 1, wherein said means for rotating rotates said rollers at an operating rate that is so selected that in the unit of time a number of cigarettes greater than that taken in by the cigarette-packing machine will be transferred to the lower section of every channel, which lower section is of such a length that it may contain a predetermined supply of cigarettes, and further comprising a plurality of upper sensors, each upper sensor being disposed in the lower section of a respective channel, a plurality of lower sensors, each lower sensor being disposed in a respective channel below the respective upper sensor, and level control means, responsive to said upper and lower sensors and cooperating with said means for rotating, for controlling the minimum level and the maximum level of cigarettes by stopping the cigarette-packing machine as long as the level of the said cigarette supply is below a minimum level determined by a lower sensor, and by stopping the respective roller as long as the level of the said cigarette supply is above a maximum level determined by the respective upper sensor.

3. The device according to claim 2, wherein said rollers are each driven in rotation by one respective electric motor which is controlled by a microprocessor according to a rate signal and in conformity with the signals from the plurality of cigarette-inspection sensor means and from the upper sensors.

4. The device according to claim 1, wherein said flutes have axes and wherein said plurality of ejector means comprises nozzles for blowing air at the intermediate positions of the flutes, said nozzles having axes that are disposed co-axially to the axes of said flutes when said flutes are in their intermediate positions.

5. The device according to claim 4, wherein said nozzles are all simultaneously fed with air under pressure, irrespective of the flute in the respective roller being in its intermediate position for the ejection of a defective cigarette.

6. The device according to claim 5, wherein each of said rollers has at least one longitudinal through duct which comes to be disposed co-axially to the respective nozzle any time the peripheral flute in the roller is located in one of its cigarette-receiving and cigarette-delivery positions.

7. A device for controlling the quality of at least one cigarette property as cigarettes move through a hopper to a cigarette-packing machine, the hopper having a plurality of downwardly extending cigarette-guiding channels that are set side by side, with each channel accommodating a single pile of cigarettes so as to allow them to slide downward toward an underlying chamber where cigarette batches consisting of at least one layer of cigarettes set side by side are formed for subsequent removal to the cigarette-packing machine, comprising:

a plurality of cigarette-inspection sensor means for checking said at least one cigarette property, each sensor means being disposed along a respective channel and being exposed, at at least one cigarette position in the respective channel, to at least one end of cigarettes moving through the respective channel;

a plurality of cigarette ejector means for discarding defective cigarettes, each ejector means corresponding to a respective channel; and a plurality of rotary cigarette-transfer device means, each disposed in a respective channel and separating the respective channel into upper and lower sections, with the respective sensor means being located at the upper section, for transferring a cigarette from the upper section of a respective channel to the lower section thereof if the respective sensor means does not detect a defect in the cigarette and for transferring the cigarette to a respective intermediate position for removal by the respective ejector means if a defect is detected, wherein each cigarette-transfer device means includes a rotatable element having an elongated peripheral flute to accommodate cigarettes, said flute being rotatable to the respective intermediate position, and wherein each ejection means includes a nozzle for blowing air at the respective intermediate position, said nozzle having an axis that is disposed substantially co-axially with respect to the flute of the respective transfer device means when the flute is in the respective intermediate position, with the nozzles of all of said plurality of ejection means being simultaneously supplied with air under pressure regardless of whether the flute in a particular transfer device means is in the respective intermediate position for removal of a cigarette.

8. The device of claim 7, wherein each rotatable element has at least one longitudinal through-duct which comes to be co-axially disposed to the respective nozzle any time the respective flute is positioned to receive a cigarette from the upper section of the respective channel.

9. The device of claim 7, wherein each rotatable element has at least one longitudinal through-duct which comes to be co-axially disposed to the respective nozzle any time the respective flute is positioned to deliver a cigarette to the lower section of the respective channel.

10. The device of claim 7, wherein each rotatable element has at least one longitudinal through-duct which comes to be co-axially disposed to the respective nozzle any time the respective flute is positioned to receive a cigarette from the upper section of the respective channel and any time the respective flute is positioned to deliver a cigarette to the lower section of the respective channel.

* * * * *